US011369165B2

(12) United States Patent
Morrison

(10) Patent No.: US 11,369,165 B2
(45) Date of Patent: Jun. 28, 2022

(54) SHOE ATTACHMENT FOR PREVENTING TOE WALKING

(71) Applicant: P J Philip Morrison, Hampstead, NC (US)

(72) Inventor: P J Philip Morrison, Hampstead, NC (US)

( * ) Notice: Subject to any disclaimer, the term of this patent is extended or adjusted under 35 U.S.C. 154(b) by 0 days.

(21) Appl. No.: 15/929,577

(22) Filed: May 11, 2020

(65) Prior Publication Data

US 2020/0352279 A1 Nov. 12, 2020

Related U.S. Application Data

(60) Provisional application No. 62/845,506, filed on May 9, 2019.

(51) Int. Cl.
*A43B 13/14* (2006.01)
*A43B 13/30* (2006.01)

(52) U.S. Cl.
CPC ..... *A43B 13/30* (2013.01); *A43B 13/145* (2013.01)

(58) Field of Classification Search
CPC ... A43B 13/143; A43B 13/145; A43B 13/146; A43B 13/148; A43B 13/30; A43B 13/36
See application file for complete search history.

(56) References Cited

U.S. PATENT DOCUMENTS 887,752 A * 5/1908 Beck et al. ..... A43B 13/148 36/7.5
1,950,041 A * 3/1934 Torchia ..... A43B 13/28 36/15
1,958,097 A * 5/1934 Shaw ..... A43B 7/22 36/144
2,518,649 A * 8/1950 Tydings ..... A43B 3/128 36/144
2,758,394 A * 8/1956 Whitlock ..... A43B 5/06 36/129
2,769,252 A * 11/1956 Monier ..... A43B 13/143 36/140
3,964,181 A 6/1976 Holcombe, Jr.
4,124,946 A 11/1978 Tomlin
4,821,432 A * 4/1989 Reiber ..... A43B 7/1465 36/110
4,843,672 A * 7/1989 Fasse ..... A43B 5/0419 12/120.5
4,934,073 A 6/1990 Robinson
5,592,757 A 1/1997 Jackinsky
5,752,330 A 5/1998 Snabb
6,170,176 B1 1/2001 Clough
6,311,416 B1 * 11/2001 Cohen ..... A43B 7/00 36/115
6,349,487 B1 * 2/2002 Hice ..... A43B 13/143 36/140
6,711,833 B1 * 3/2004 Ransan ..... A43B 5/12 36/8.3

(Continued)

FOREIGN PATENT DOCUMENTS

GB 2527037 A * 12/2015

*Primary Examiner* — Ted Kavanaugh
(74) *Attorney, Agent, or Firm* — Dunlap Bennett & Ludwig, PLLC

(57) ABSTRACT

A tipping bar for preventing toe walking and other gait abnormalities is provided. The tipping bar may be integrated to the sole of a footwear, forcing weight on the heel, preventing toe walking.

10 Claims, 3 Drawing Sheets

(56) References Cited

U.S. PATENT DOCUMENTS

| | | | | |
|---|---|---|---|---|
| 8,448,352 | B2 * | 5/2013 | Ryu | A43B 13/145 36/25 R |
| 9,730,489 | B2 * | 8/2017 | Park | A43B 21/00 |
| 10,433,615 | B2 * | 10/2019 | Park | A43B 7/1445 |
| 2002/0026730 | A1 * | 3/2002 | Whatley | A43B 13/146 36/132 |
| 2003/0033732 | A1 | 2/2003 | Jackinsky | |
| 2003/0226283 | A1 * | 12/2003 | Braunschweiler | A43B 13/36 36/29 |
| 2005/0138840 | A1 * | 6/2005 | Feldstein | A43B 13/36 36/8.3 |
| 2005/0160625 | A1 | 7/2005 | Whatley | |
| 2006/0090372 | A1 | 5/2006 | Kim | |
| 2007/0204487 | A1 | 9/2007 | Clough | |
| 2007/0227043 | A1 | 10/2007 | Hinten | |
| 2008/0289224 | A1 * | 11/2008 | Sink | A43B 13/181 36/103 |
| 2009/0049713 | A1 | 2/2009 | Baek | |
| 2009/0094859 | A1 | 4/2009 | Baek | |
| 2009/0193687 | A1 * | 8/2009 | Kim | A43B 13/145 36/103 |
| 2010/0242310 | A1 | 9/2010 | Gourineni | |
| 2011/0224049 | A1 | 9/2011 | Farrell | |
| 2011/0296715 | A1 | 12/2011 | Howell | |
| 2012/0240431 | A1 | 9/2012 | Colclough | |
| 2012/0266499 | A1 | 10/2012 | Dat | |
| 2014/0000128 | A1 | 1/2014 | McManus et al. | |
| 2016/0296412 | A1 | 10/2016 | Thomas | |
| 2017/0224048 | A1 | 8/2017 | Nagano et al. | |
| 2017/0273400 | A1 * | 9/2017 | Penka | A43B 13/145 |
| 2018/0036577 | A1 | 2/2018 | Leary | |

* cited by examiner

SHOE ATTACHMENT FOR PREVENTING TOE WALKING

CROSS-REFERENCE TO RELATED APPLICATION

This application claims the benefit of priority of U.S. provisional application No. 62/845,506, filed 9 May 2019, the contents of which are herein incorporated by reference.

BACKGROUND OF THE INVENTION

The present invention relates to toe-walking prevention solutions and, more particularly, to a tipping bar added to the underside or sole of the footwear for preventing the wearer from walking on their toes or any other gait deviation.

Children with neurological deficits often suffer with idiopathic toe walking and other disorders related to gait. Other ankle foot orthosis and shoe modifications still allow a child to walk on their toes by compensating in other ways.

Current solutions simply do not work because they do not force weight through or onto the heels of the footwear of the wearer. Current methods to stop toe-walking attempt to prevent the ankle from plantarflexing. For example, a child can bend their knees and walk on their toes with existing products. These are uncomfortable and still allow the wearer to bend their knees to walk on their toes.

As can be seen, there is a need for a tipping bar added to the front sole of footwear for preventing the wearer from walking on their toes. The bar may be made of material that is elastic and/or hyper-elastic and possessing an inherent restoring force as a function of a stress-strain behavior that exhibits, in certain embodiments, the Mullin effect and the Payne effect. The present invention is attached to the front sole of the footwear, tipping weight onto heels thus preventing the wearer from walking on their toes. With the proper attachment and placement of the present invention it is impossible to walk on toes as the mass of the wearer of the footwear is forced onto heel eliminating toe walking. This invention may also be added to any portion of the sole to correct gait dysfunction.

SUMMARY OF THE INVENTION

In one aspect of the present invention, a footwear attachment for preventing toe-walking includes the following: a tipping bar extending along an underside of the footwear in a direction orthogonal to a longitudinal direction of the footwear, wherein the tipping bar is made of non-slip and elastic material, wherein the tipping bar extends substantially a width of said underside, the width orthogonal to said longitudinal direction or wherein the tipping bar extends at least a half of a width of said underside, the width orthogonal to said longitudinal direction; and further either including a plurality of fasteners connecting the tipping bar to and through said underside wherein the plurality of fasteners comprises binding barrels and screws that can operatively associate; and a plurality of pairs of aligned countersunk holes in top surfaces of both the tipping bar and the underside, respectively, and wherein said countersunk holes receive the plurality of fasteners; or wherein the tipping bar is either integrated to said underside or wherein the tipping bar and the underside are a unitary construction. The tipping bar is adapted to be located adjacent to a base of toes of a wearer of the footwear.

In another aspect of the present invention, a method of making a footwear toe-walking proof includes the following: attaching the above-mentioned tipping bar to the underside of the footwear in such a way that directing a weight of a user of said footwear to a heel of the footwear, wherein the tipping bar is located adjacent to a base of toes of the wearer.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, one embodiment of the present invention is a device that is attached to the forefoot of a shoe, or a shoe modification that prevents toe walking by forcing weight into the heel. The present invention may attach to any part of the sole of the shoe.

Figure 1:
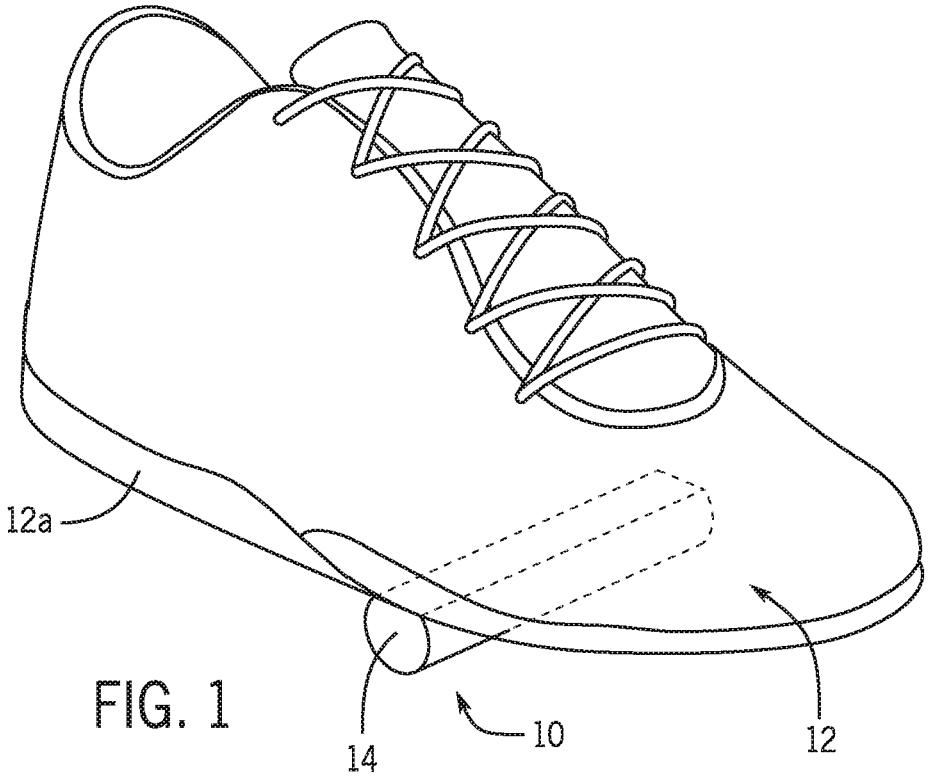
FIG. 1 is a perspective view of an exemplary embodiment of the present invention, shown in use.
Figure 2:
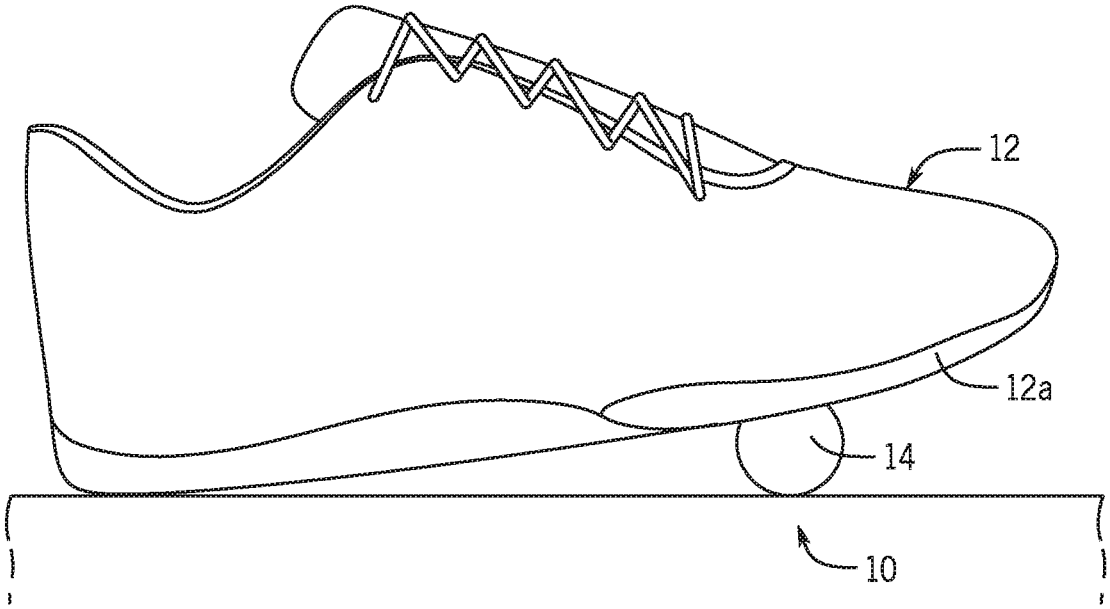
FIG. 2 is a side elevation view of an exemplary embodiment of the present invention, shown in use.
Figure 3:
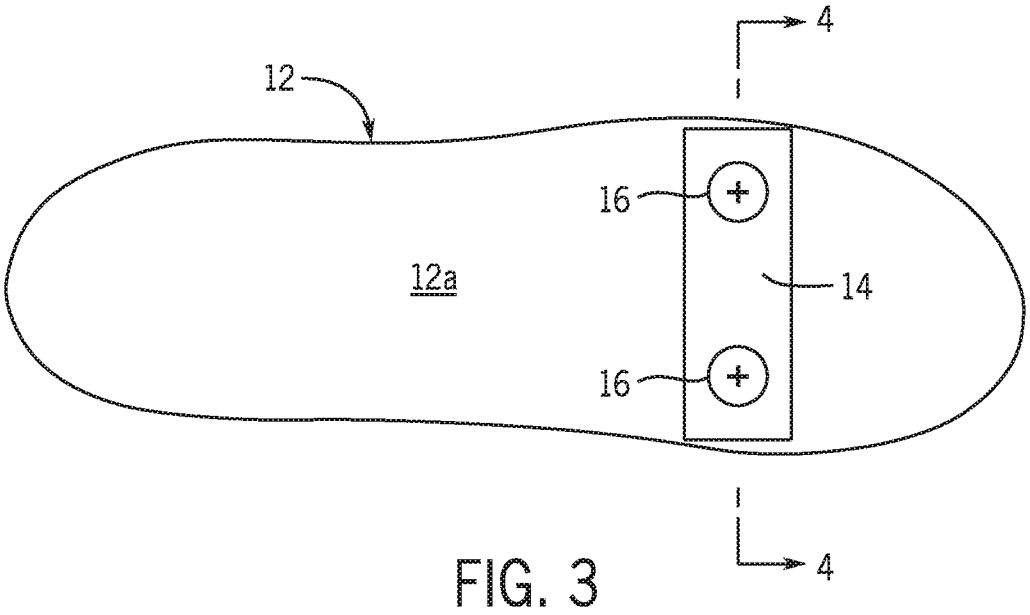
FIG. 3 is a bottom plan view of an exemplary embodiment of the present invention.
Figure 4:
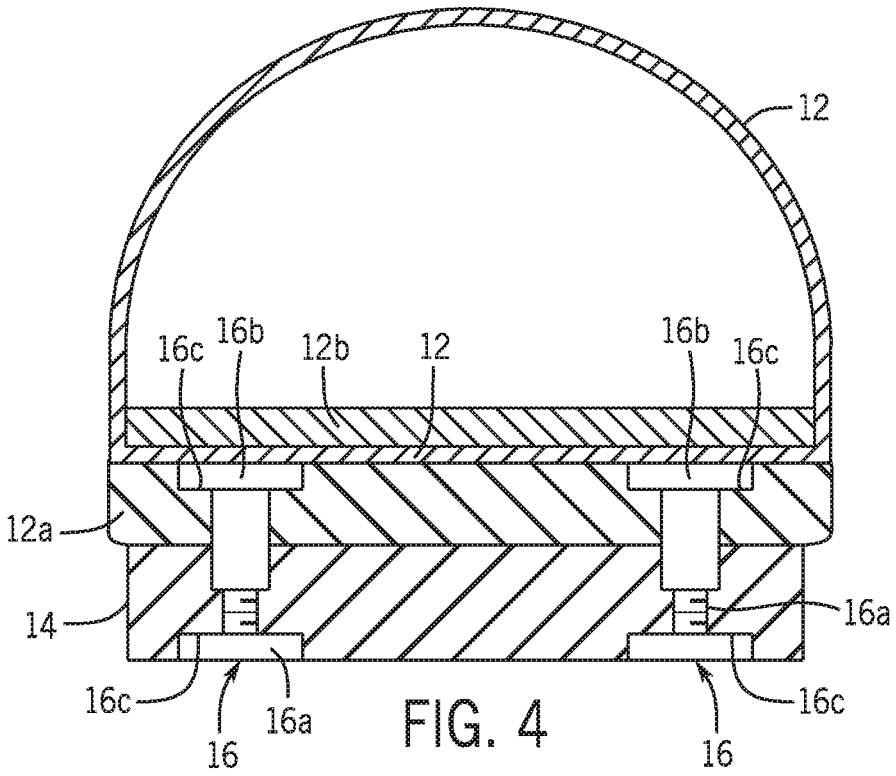
FIG. 4 is a cross-sectional view of an exemplary embodiment of the present invention, take along line 4-4 in FIG. 3.
Figure 5:
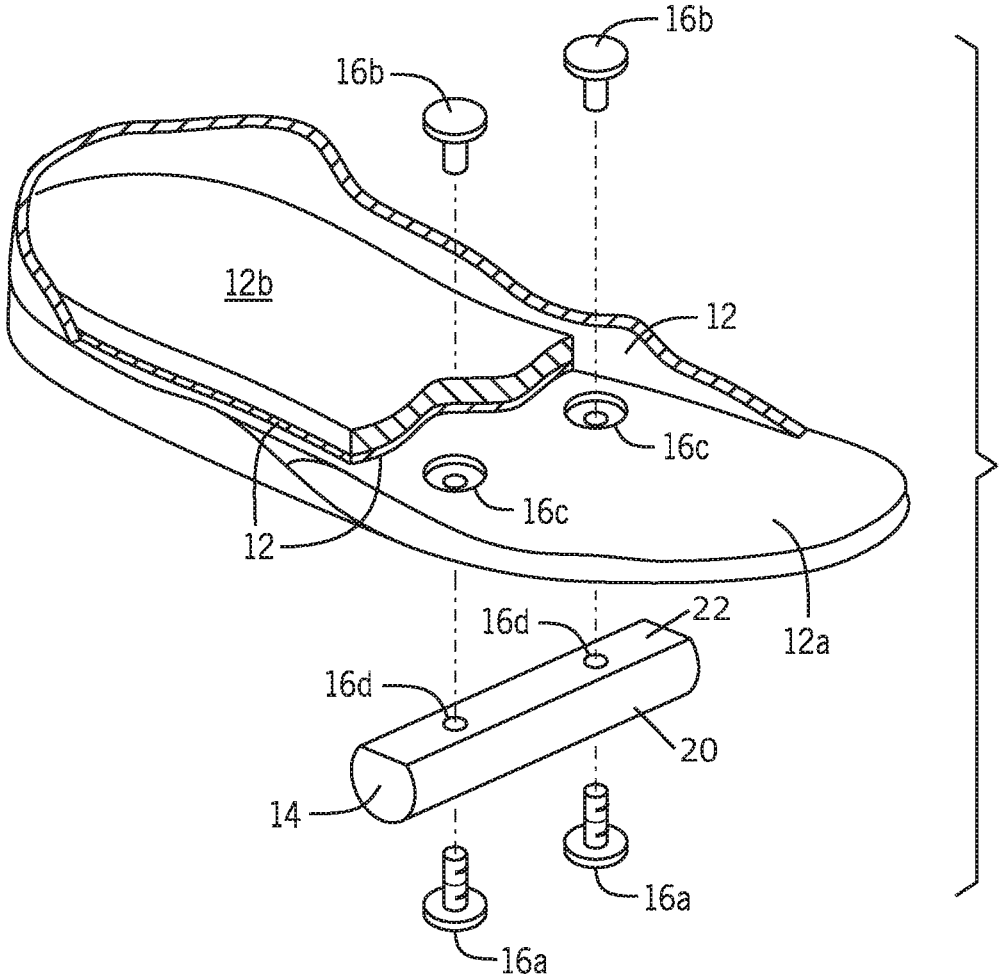
FIG. 5 is an explosive perspective view of an exemplary embodiment of the present invention.
Figure 6:
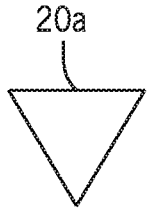
FIGS. 6, 7 and 8 show various cross-sectional views of exemplary embodiments of the present invention.
Figure 7:
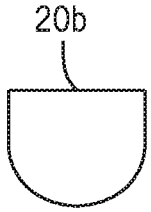
Figure 8:
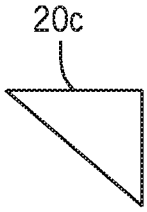

Referring to FIGS. 1 through 8, the present invention may include a toe-walking prevention system 10 embodying a tipping bar 14 and fasteners 16-16*d* for connecting the tipping bar 10 to a predefined location of a lower portion 12*a* of footwear 12.

The tipping bar 14 may be made of material that is elastic and/or hyper-elastic and possessing an inherent restoring force as a function of a stress-strain behavior that exhibits, in certain embodiments, the Mullin effect and the Payne effect. The material could be rubber, natural or synthetic, or other plasticized materials with similar properties. The tipping bar 14 also exhibits non-slip properties.

The tipping bar 14 may be connected to the lower portion 12*a* so as not impact an insert 12*b* of the footwear 12. To that end, the lower portion 12*a* may have upper countersunk holes 16*c* along an upper portion thereof. Likewise, a bottom portion of the tipping bar 14 may also provide bottom countersunk holes 16*d* that align with the upper countersunk holes 16*c* so that binding barrel/screw sets 16, screws 16, and a binding barrel 16*b* can operatively associate through each pair of aligned countersunk holes 16*c*/16*d*, ensuring the tipping bar 14 has no risk of coming loose. The fasteners can be other components that securely connect the tipping bar 14 to the lower portion 12*a*.

The tipping bar 14 may provide a planar inward portion 22 that engages the lower portion 12*a*. The outward portion 20 may be an equilateral triangle shape 20*a*, a half-rounded shape 20*b*, an ortho-triangular shape 20*c*, or other shapes that producing the 'tipping effect' for the present invention to function as contemplated herein.

The present invention can also be embodied in a unitary construction of the lower portion 12*a* and/or the footwear 12 itself. For instance, the lower portion 12*a* may be formed with the tipping bar 14 running horizontal to the bottom of the toes. For the rounded shape 20*b*, the circumference may range from that a C battery to AA battery depending on the size of the foot. In other words, the diameter or cross-sectional thickness of the tipping bar 14 may be between 0.3 to 1.2 inches or greater or smaller.

In one embodiment, the lower portion/sole 12*a* with the raised tipping bar is attached to an existing footwear with hook-and-loop/straps, or any other suitable mechanism. The straps hold the new sole on the footwear 12, enabling the tipping bar 14 to prevent toe walking, while allowing the wearer to don their preferred footwear 12. Additionally, this embodiment may be added to other footwear, for other users or for the same user who has chosen a different pair of footwear 12. In any event, due to the position of the tipping bar 14, the weight is forced back on the heel, thus preventing toe walking.

In one embodiment, the invention is sized, based on the patients' shoe. The insole matches the bottom of the current shoe. The size of the cylinder or triangle bar is as wide as the sole of the forefoot and is placed just above the base of the toes. The height of the cylinder/triangle is based on the shoe size and size of the person. In one embodiment, the smallest height possible is used for the desired result thus preventing toe walking.

The tipping bar 14 being placed properly is important for the invention to work as desired and may be modified with different shapes and sizes of the forefoot lift. Round and triangle shaped tipping bars 14 have shown good results, however, any suitable shape may be used. In one embodiment, the device may be moved forward or backward slightly for optimal results.

A method of making the present invention may include using additive manufacturer or other suitable modalities to make the appropriately sized tipping bar 14, separately, as part of a unitary construction of the lower portion 12*a*/sole and/or footwear 12 itself. The tipping bar 14 is disposed along the proper location toward the front sole/lower portion 12*a* of the footwear 12, orthogonal to a longitudinal axis of the footwear 12, in order to prevent wearer from walking on their toes. Sizing could easily be adjusted to fit any size person/shoe.

Once the tipping bar 14 is attached to the footwear 12, the wearer simply walks and is unable to walk on their toes or at least it is extremely difficult if the attachment is the correct size/fit.

It should be understood, of course, that the foregoing relates to exemplary embodiments of the invention and that modifications may be made without departing from the spirit and scope of the invention as set forth in the following claims.

What is claimed is:

1. A system for prevention of toe walking comprising:

a shoe sole comprising a front sole area and a heel area, where a direction from the front sole area to the heel area together generally defines a longitudinal direction of the shoe sole; and a bar of material, comprising non-slip and elastic material, located only at and projecting only out of the front sole area only at a forefoot of the shoe sole substantially at the widest part of the forefoot, and extending in a direction across the shoe sole perpendicular to the longitudinal direction; whereby the bar of material is so dimensioned and so located that weight of a wearer of a shoe containing said shoe sole shifts substantially to the heel and not toes during regular use, thus preventing toe walking;

wherein the bar of material comprises a structurally separate attachment from the shoe sole, and is integrated into the shoe sole using fasteners; wherein the bar of material is placed across substantially all of the width at the widest part; and wherein the bar of material has a cross-section, and the cross-section substantially comprises a triangle, such that a length of the bar comprises a planar inward portion for joining with the shoe sole and two substantially legs of the triangle project outwardly from the shoe sole.

2. The system of claim 1 wherein the bar of material has a thickness between 0.3 and 1.2 inches.

3. The system of claim 1 wherein the bar of material is so dimensioned and so located that it tends to cause a tipping action backward toward the heel during a walking gait, potentially bearing substantially all weight of the wearer during such tipping action, thus discouraging a wearer from lifting the heel during the walking gait.

4. The system of claim 3 comprising apertures in the bar of material.

5. The system of claim 4 wherein the apertures each comprise countersunk holes on each end.

6. The system of claim 5, further comprising a two-piece fastener in each aperture, a first piece of each fastener being a male screw, and a second piece being a female piece comprising a threaded insert that also passes through a paired countersunk aperture in said shoe sole, whereby through binding barrels and screws that can operatively associate, respective countersunk holes in the shoe sole and the bar of material are integrated together.

7. The system of claim 6 comprising exactly two fasteners and two apertures, one fastener in each aperture.

8. An item of footwear comprising the system of claim 1.

9. The system of claim 8 wherein the bar of material and the shoe sole are a unitary construction.

10. The system of claim 1 wherein the shoe sole anterior zone has a width across the shoe sole, and the bar of material is placed across at least half of the width.

* * * * *